United States Patent [19]

Huang

[11] 4,348,432

[45] Sep. 7, 1982

[54] METHOD FOR COATING WITH RADIALLY-PROPAGATING, FREE, LIQUID SHEETS

[75] Inventor: John C. Huang, Roseville, Minn.

[73] Assignee: Minnesota Mining and Manufacturing Company, St. Paul, Minn.

[21] Appl. No.: 675,068

[22] Filed: Apr. 8, 1976

[51] Int. Cl.[3] ..... B05D 1/36; B05D 7/00

[52] U.S. Cl. ..... 427/402; 427/404; 427/412.5; 427/414; 427/419.2; 427/424; 427/427

[58] Field of Search ..... 427/402, 414, 419 R, 427/419 D, 424, 420, 427; 118/316, 317, 318; 96/87 R, 85

[56] References Cited

U.S. PATENT DOCUMENTS

| | | | |
|---|---|---|---|
| 2,681,294 | 6/1954 | Begun | 118/324 |
| 2,761,791 | 9/1956 | Russell | 118/410 |
| 2,943,001 | 6/1960 | Socke | 118/317 |
| 3,425,857 | 2/1969 | Bacon et al. | 96/87 R |
| 3,508,947 | 4/1970 | Hughes | 118/324 |
| 3,632,374 | 1/1972 | Greiller | 427/420 |
| 3,920,862 | 11/1975 | Damschroder et al. | 427/420 |
| 3,973,062 | 8/1976 | Fahrni | 427/414 |
| 4,004,045 | 1/1977 | Stelter | 427/420 |

OTHER PUBLICATIONS

Huang, C. P., "Dynamics of Free Axisymmetric Liquid Sheets", Aug. 1967.

*Primary Examiner*—Norman Morgenstern
*Assistant Examiner*—S. L. Childs
*Attorney, Agent, or Firm*—Cruzan Alexander; Donald M. Sell; Warren R. Bovee

[57] ABSTRACT

Radially-propagating, free, liquid sheets comprising single or multiple discrete layers are used to coat moving substrates. The use of these free liquid sheets allows the high speed application of single or multicomponent coatings to substrates. Apparatus for forming radially-propagating, free, liquid sheets and applying the sheets to substrates in the form of coatings is also disclosed.

4 Claims, 6 Drawing Figures

$r_s$
y
$r_b$
14
2
6
10
8
7
4
12

64
60
50
Y
54
θ
P
56
52
Z
62

$L_1$
Y
2
14
5
$L_1$
$L_2$
6
10
$L_1$
$L_2$
8
7
12
4
$L_2$
$r_s$ $L_2$
Y
25
20
$L_1$
22
$L_1$
23
24
21
26
40
36
31
34
$L_4$
32
30
35
$L_3$
$L_1$
$L_2$
$L_3$
$L_4$
44
42

70
72
74
76
78
79
80
82
84
86
88
90
91
92
94
95
96
98
100
102
104
105
106
110
112
114
116
118
120
122
124
126
128
130
132
134
136
138
140
L1
L2
P
V 110
72
130
132
134
138
76
116

METHOD FOR COATING WITH RADIALLY-PROPAGATING, FREE, LIQUID SHEETS

The present invention relates to a method and apparatus which provides for the high-speed, uniform coating of substrates with thin films or layers of liquid materials. In a preferred embodiment of the present invention a radially-propagating, free, liquid sheet is formed by the impingement of two liquid jets wherein a free, liquid sheet is formed containing one or more liquid layers in laminar flow. The liquid sheet is caused to impinge on a moving substrate whereby a liquid coating which can comprise a plurality of discrete layers is applied to the substrate.

In many different areas of technology it is necessary to coat a layer onto the surface of a substrate or onto another layer with precise control of layer thickness. Many different techniques have been developed in order to form more uniform and more readily applied layers. Such techniques include roller coating, knife-edge coating, pouring, curtain coating, etc. All of these methods have utility in different areas of manufacture and processing, but suffer from certain disadvantages, especially a lack of uniformity in the thickness of the applied coating layers. For example, defects on the edges of knife-coating implements leave distinctive deformities in the coating as do imperfections on roller surfaces. Control of uniformity in thin layers is especially difficult with such apparatus.

Curtain coating techniques avoid some of the problems of the previously mentioned knife and roller coating methods, but the high speed coating of substrates with thin layers is not always satisfactory. As with other coating techniques, the layer applied to the moving web or substrate in a curtain coating operation is not always uniform due to machine precision of the coating orifice and other inherent fluid properties and also due to external disturbances affecting the liquids forming the curtain. These difficulties are often magnified at high coating speeds.

U.S. Pat. No. 2,681,294 issued June 15, 1954 to Beguin and U.S. Pat. No. 2,761,791 issued Sept. 4, 1956 to Russell relate to a multilayer coating method wherein there is simultaneously provided several coating solutions in distinct layers which flow from a liquid-containing hopper to form a bead across, and in contact with, a substrate to be coated. The substrate is continuously moved and draws the coating from the bead in the form of distinct layers. The thickness of the layers is dependent upon the rate at which the solutions are individually fed to the bead. Due to the close proximity of the supply hopper to the substrate, and the formation of a bead between the hopper and the substrate, there is no free falling liquid curtain formed and thus some difficulties inherent in a curtain coating process, e.g. effect of external air currents, etc. on the curtain, are reduced or eliminated. However, due to the close proximity of the coating hopper to the web, other difficulties are encountered in this process. For example, the gap between the web and the hopper must be critically uniform to maintain the proper bead conformation. Splices in the web require the interruption of the coating process since the bead is disturbed if the splice is thicker or thinner than the substrate. Thus, the bead method is not adapted to the coating of individual or discrete sheets.

The viscosity of the liquids to be coated is critical and confined to a relatively narrow range.

U.S. Pat. No. 3,508,947, issued Apr. 28, 1970 to D. J. Hughes discloses a curtain coating method whereby there is simultaneously applied a plurality of coating layers to a substrate. While adapting the curtain coating concept to provide for the application of a multilayer coating process, the method still is subject to the difficulties inherent in curtain coating methods as previously noted.

An annular curtain coating method is described in British Pat. No. 1,122,021 (published July 31, 1968). Coating by this method is accomplished by forming an annular curtain of liquid about a vertical axis such that the curtain contracts as it falls from the forming annulus and contacts a tubular body being continuously fed downwards and centrally within the curtain of liquid. The tubular body is thereby coated over its entire periphery as it passes the point of contact with the curtain. By controlling various parameters of the process, the coating speed and the thickness of the coating can be controlled. In addition, it is proposed to form multilayer coatings by forming concentric curtains which may or may not be in contact with each other prior to contacting the tubular body to be coated.

The dynamics of aqueous liquid sheets has been studied extensively by C. P. Huang and others. Particular reference is made to "Dynamics of Free Axisymmetric Liquid Sheets", by C. P. Huang, Bulletin 306, published by Washington State University, College of Engineering, Research Division, Technical Extension Service, Pullman, Washington (August 1967), and references cited therein. This report states that axisymmetric sheets formed by the impingement of single component liquid jets might be adapted for use in applying a protective coating to metal and plastic strips.

The present invention overcomes the deficiencies inherent in the coating methods and apparatus known in the prior art by providing a liquid jet in laminar flow which is directed into contact with an impingement surface to provide a continuous, radially-propagating, free, liquid sheet in substantially laminar flow, and by moving a single substrate or a plurality of substrates to be coated relative to the plane of the liquid sheet so as to intercept at least a portion of the liquid sheet within the periphery of the sheet, thereby causing the liquid to impinge on the substrate and coat the substrate.

The coating method of the present invention can be readily performed by employing a coating apparatus comprising nozzle means for providing a liquid jet in laminar flow and impingement means adapted to be struck by and to uniformly direct the jet into a continuous, radially-propagating, free, liquid sheet in laminar flow. The liquid jets described herein may be a single jet comprising a single liquid or a mixture of liquids or can be a composite jet containing two or more discrete liquid streams each of which may be the same or different and which may also be a single liquid or a mixture of liquids. The impingement means can be any solid or liquid deflecting mass such as a stationary deflecting surface such as a solid plate or, preferably, a second liquid jet. The apparatus also comprises substrate transport means for transporting one or more substrates relative to the plane of the liquid sheet so that a substrate can intercept at least a portion of the continuous liquid sheet whereby at least a portion of the liquid sheet is deposited as a continuous coating on the substrate.

The method and apparatus of the present invention can provide uniform coatings of a single layer of a single liquid or mixture of liquids on a substrate or multiple distinct layers of a plurality of distinct liquid coating materials with a single exposure of the substrate to the liquid sheet. The present coating method has the advantage that substrates can be uniformly coated while moving at extremely high velocity while providing precise control of the coating thickness and quality. Since the moving substrate is not passed beneath a knife edge or coating bar set closely to the substrate, the problem of streaking due to improper viscosity, particles, or imperfections in the knife edge or bar is minimized. The apparatus employed n the present invention is also advantageous in that machining to the required close tolerances of the orifices and nozzles employed in the present apparatus is less costly and difficult than the machining of close tolerance knife edges and other long bars or rectangular orifices used in the prior art coating methods and apparatus.

Certain aspects of the invention can be more clearly understood by reference to the preferred embodiments shown in the drawing wherein.

Figure 1:
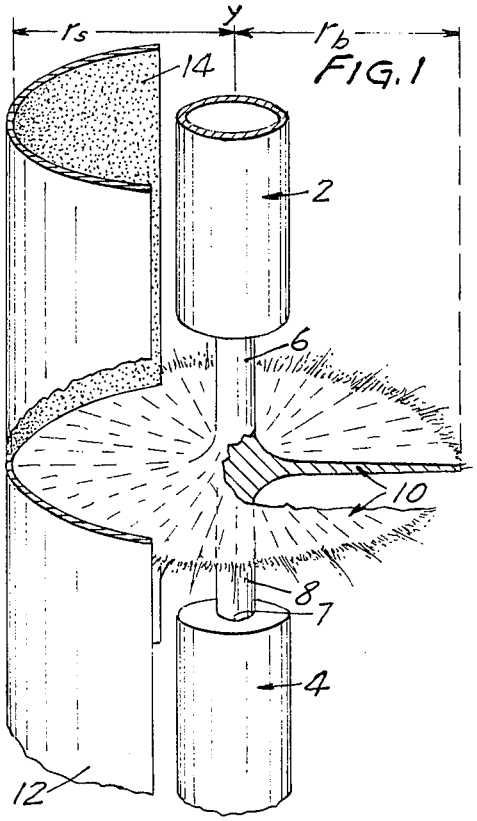
FIG. 1 is a partially fragmented perspective view of a jet impingement coating system adapted for coating a moving substrate.

FIG. 1 shows the basic elements of a jet impingement coating system comprising vertically opposed orifice tubes 2 and 4 containing orifices 5 (not shown) and 7 having a common axis, Y, (i.e. the orifices are "uniaxial"). Liquid jets 6 and 8, which may be formed from the same or different liquids or mixtures of liquids, are shown issuing from tubes 2 and 4, respectively. Jets 6 and 8 are in laminar flow and have substantially equal momentum, impinging on each other about midway between the ends of tubes 2 and 4 and forming liquid sheet 10. Liquid sheet 10 is a radially-propagating, free, liquid sheet disposed in a horizontal plane and is substantially symmetric about the point of impingement of the liquid jets 6 and 8. The sheet 10 propagates outwardly in a laminar flow mode. As the liquid in sheet 10 propagates radially outward in laminar flow from the point of impingement of jets 6 and 8, the sheet 10 eventually becomes unstable and ultimately becomes discontinuous, breaking up into discrete droplets. The radius at which the discontinuity occurs is called the breakup radius, $r_b$, of the sheet.

Substrate 12 intersects sheet 10 at a radial distance, $r_s$, from the point of impingement of jets 6 and 8. Substrate 12 preferably intercepts the liquid sheet 10 at a constant radius within the breakup radius, $r_b$, of sheet 10 so that a uniform, continuous coating 14 will be applied to substrate 12. If substrate 12 is located so as to intercept sheet 10 outside of the breakup radius, a discontinuous, non-uniform coating of the substrate can result.

Substrate 12 is indicated moving vertically with respect to horizontal liquid sheet 10. The linear velocity of substrate 12 is preferably approximately equal to the linear velocity of the liquid in sheet 10 as the liquid propagates outwardly from the point of impingement of jets 6 and 8. By controlling, and preferably substantially matching, the velocities of the propagating liquid in sheet 10 and the moving substrate 12, an even, undisturbed, liquid coating 14 is continuously applied to the surface of substrate 12.

Liquid sheet 10 may comprise a single liquid or may be a composite sheet comprising a plurality of liquid layers which may be the same or different, as described in greater detail hereinafter. The liquid layers remain as distinct layers throughout the continuous composite liquid sheet 10 due to the composite sheet being in a substantially laminar flow mode. By "laminar flow" it is meant that the streamlines of the liquid are parallel and do not intersect and, accordingly, no significant mass transfer occurs perpendicular to the direction of flow. Because the liquid within the sheet 10 is in a laminar flow mode, liquid layers of the same or different composition, even miscible layers, when in contact with one another in the laminar sheet, will not mix to any significant extent during the very short time it takes the liquid layers to flow to the periphery of the liquid sheet or to the point of impingement with a moving substrate.

The jets 6, 8 which impinge to form the liquid sheets used in the present invention are continuous jets of liquid in laminar flow. Most preferably, the jets are cylindrical in shape, having a substantially circular cross section. A "continuous" jet is a jet which is not hollow and which does not have any gross irregular formations or pockets within the jet, although small uniformly dispersed particles of liquid or solid can be included.

The radially-propagating, free, liquid sheets used in the present invention are formed by the impingement of a jet of liquid upon an unyielding surface. When the jet of liquid is caused to impinge upon a radially symmetric surface at an angle approximately perpendicular to the unyielding surface, a symmetric sheet will be formed. When the angle is varied from the perpendicular or the surface is not radially symmetric, an asymmetric sheet will be formed as described hereinafter.

In a preferred embodiment of the present invention, two independent liquid jets are caused to impinge upon each other at an angle of about 180°, that is, they must travel on a collision course along a common axis. The relative velocity and diameter of the jets must be controlled so that one jet will not drastically overpower the other jet, causing it to break up and thereby preventing the formation of a symmetric, composite sheet of laminarly flowing streams. For coating two layers of equal thickness, the momentum of the impinging jets should be very nearly the same. The diameter and velocity of the impinging jets may differ within a reasonable range as long as the momentums of the jets are substantially equal. When one of the jets has a momentum slightly greater than that of the other impinging jet, it is preferred to have the high momentum jet rise vertically to meet the other jet. This will cause the initial angle of the plane of the resulting liquid sheet about the point of impingement to be slightly above the horizontal. When the jet having the greater momentum is directed downwardly in a perpendicular direction, the initial angle of the plane of the liquid sheet will be below the horizontal. The greater the difference in momentum of the impinging jets, the greater the initial angle of the resulting liquid sheet with the horizontal plane. When the angle is too great, the distance from the point where the jets impinge to the breakup radius of the liquid sheet may be shortened to the point where it is not useful in a coating process.

The jets used in the coating process of this invention are produced by passing the coating liquid through an orifice under controlled pressure. The pressure must be sufficient to give the jet a momentum great enough to generate a radially-propagating, free, liquid sheet when the jet impinges on the surface of another jet, but not so great as to generate turbulent flow in the jet or the resulting liquid sheet. The orifices used in producing the liquid jets may be any symmetric orifice or nozzle, and is preferably a circular orifice or nozzle which is capable of emitting a continuous jet in laminar flow.

The liquid sheets generated by the impingement of two liquid jets radiate outwardly and eventually become discontinuous, breaking up into discrete droplets. The breakup radii of the free, liquid sheets of the present invention can be readily observed with the naked eye. Determination of the breakup radius for a particular liquid sheet is necessary in order to determine the distance from the point of impingement at which the substrate to be coated should be placed. If the substrate is placed so that the substrate intercepts the liquid sheet at a point within the breakup radius of the sheet, a smooth uniform coating will result (assuming the substrate moves past the interception point at an appropriate uniform velocity). On the other hand, if the substrate is located so as to intercept the liquid sheet outside of the breakup radius (again assuming the appropriate uniform movement) the coating applied to the substrate is non-uniform and discontinuous.

As noted previously it is preferred to minimize the relative velocity of the moving substrate and the liquid in the liquid sheet. For the most uniform coating results, the substrate velocity should approximate that of the composite liquid sheet. The similarity in velocity of the composite liquid sheet and the substrate at the point of impingement of the sheet on the substrate reduces the shear and drag forces within the liquid coating as it contacts the substrate and makes possible the high speed uniform coating of the substrate without breakup of the liquid sheet. The viscous shear within the liquid sheet for liquids having viscosities below $10^4$ centipoise is small. Therefore, for most liquids the liquid within the sheets has substantially the same velocity as that of the liquid jets at the point of collision. The range of liquid velocities which can be advantageously employed in the present invention is about 5 to 23 ft. per second (1.5 to 7 meters per second). At the low velocities, gravitational forces will cause the horizontal liquid sheet to curve excessively. At very high liquid velocities, e.g., above 23 ft. per second, the liquid sheet will tend to break up prior to reaching the maximum breakup radius and may be too small to be conveniently used for coating. Liquid velocities ranging from about 8 to about 12 ft. per second (2.4 to 3.7 meters per second) are preferred and can readily produce a free, liquid sheet having a breakup radius of 4 inches or more. The velocity of the liquids discharged from the orifice, and hence the velocity of the liquids in the liquid sheet, can be determined by well-known methods.

If the substrate is moved at a velocity greater than the velocity of the liquid in the sheet, the thickness of the liquid coating will be less than if the velocities are equal. It is generally not desirable to maintain the velocity of the substrate at a rate less than the velocity of the liquid sheet since non-uniform buildup on the substrate will result and undesirable mixing may occur between the discrete laminae of a composite liquid sheet during impingement of the liquid on the substrate.

The substrates useful in the practice of this invention can be any material to which a coating can be applied. In certain preferred embodiments of this invention, substrates which are flexible so as to be capable of being formed to an arcuate shape and subsequently returned to a flat configuration are preferred, but rigid substrates can also be useful in the practice of this invention. Further, the term "substrate" is not limited to a continuous sheet material, but can include continuous or discontinuous substrates. Preferred substrates are flexible sheets such as paper or synthetic organic polymers such as polyester films or a photographic film base, e.g. acetate films. Other geometries, such as blocks, spheres, irregular 3-dimensional shapes, etc., can be coated by this method, but are not preferred because the edges or the areas not perpendicular to the direction of flow of the liquid sheet will not be uniformly or completely coated since the liquid sheet will not effectively wrap around a three-dimensional article.

Figure 2:
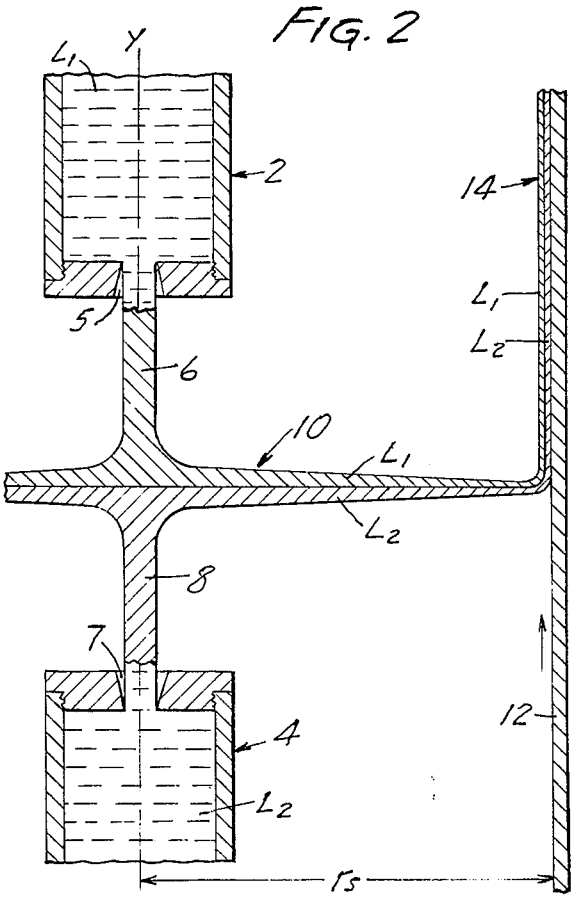
FIG. 2 is a cross section of the jet impingement system similar to that shown in FIG. 1.

FIG. 2 is a cross sectional view of the coating sysem shown in FIG. 1 wherein orifice tubes 2 and 4 contain liquids $L_1$ and $L_2$, respectively, and which may be the same or different liquids. Liquid $L_1$ issues through orifice 5, under pressure, to form jet 6. Similarly, liquid $L_2$ issues from orifice 7 to form jet 8. Jets 6 and 8 impinge to form liquid sheet 10 comprising distinct layers of liquid $L_1$ and $L_2$. Sheet 10 is a radially -propagating, free, liquid sheet which is symmetric about the point of impingement of jets 6 and 8. The liquid in the sheet propagates outwardly in a laminar flow mode at a linear velocity approximately equal to the velocity of the liquid in jets 6 and 8. Because the flow is laminar, the layers comprising liquids $L_1$ and $L_2$ do not readily mix during their relatively short residence time in he sheet, even if they are mutually soluble liquids.

Because the liquid layers $L_1$ and $L_2$ do not readily mix, it is possible to have the multiple layers in the liquid sheet coated onto a surface and arranged on that surface in the layered relation in which they existed during the laminar flow in the liquid sheet. Even liquid layers of the same solvent with different solutes or particles or liquid layers having different concentrations of the same solute or particles may be coated as distinct and separate contiguous layers by this process. Of course, if the composition of the layers in the liquid sheets are identical, the resulting coating on the substrate will approximate a single uniform coating layer. The liquid components or layers may comprise solutions, solvents, emulsions, dispersions, or the like, and may be miscible or immiscible with one another. For example, photographic films comprising a layer of gelatin and a layer of silver emulsion, with either layer as the base or top coat, can be coated in a single pass with simultaneous application of the coating layers.

Substrate 12 intercepts liquid sheet 10 at a constant radial distance, $r_s$, inside the breakup radius of sheet 10 and moves upwardly at a velocity substantially equal to the velocity of liquids $L_1$ and $L_2$ in sheet 10. Liquid sheet 10 impinges on substrate 12 and is carried away on substrate 12 as coating 14 comprising distinct liquid layers $L_1$ and $L_2$. As shown in FIG. 2, the thickness of sheet 10 decreases as the distance from the point of impingement of jets 6 and 8 increases, and the thickness of coating 14 corresponds to the thickness of liquid sheet 10 at the point at which the sheet 10 impinges on substrate 12. Moving the substrate closer to the pont of impingement will produce a thicker coating. Moving the substrate away from the point of impingement produces a thinner coating (assuming equal substrate velocities). However, it must be remembered that the radial distance at which substrate 12 intercepts sheet 10 must always be less than the breakup radius of the sheet 10 to provide a uniform, continuous coating.

The thickness of liquid sheet 10 can be measured by physical techniques, e.g. optical methods, or can be readily observed by applying the coating to a substrate and measuring the thickness of the applied coating. The thickness of the liquid sheet 10 can also be predicted mathematically. Assuming that the liquid velocity is nearly uniform throughout the sheet and is linearly proportional to the pressure head which produces the impinging jwts, the thickness, h, of the liquid sheet can be expressed in the following terms.

$$h = \frac{C_c d^2}{4r} \quad \text{(I)}$$

x where

Cc=Coefficient of contraction of jets ≅0.66 d=diameter of orifice producing the jet, cm r=radius of the sheet at point where h is determined, cm.

This expression can be derived by reference to the general formula relating the volumetric flow rate, Q, to the velocity and thickness of the liquid sheet at radius r. Thus, in the symmetric sheet, according to continuity theory, $$Q_s = 2\pi r\ h\ U_s \quad \text{II}$$

Equation (II) can be rearranged to yield $$h = \frac{Q_s}{2\pi r U_s} \quad \text{(III)}$$

wherein h=thickness of sheet at radius r in cm.

$Q_s$=volumetric flow rate of liquid in sheet; $cm^3$/sec.

$U_s$=velocity of liquid in sheet in cm/sec.

r=radius of sheet.

It is also known that the volumetric flow rate of the liquid in one jet can be expressed as $$Q_j = \frac{\pi d^2}{4} U_j C_c \quad \text{(IV)}$$

wherein $Q_j$=volumetric flow rate of jet, cm/sec.

d=diameter of orifice, cm.

$C_c$=coefficient of contraction of jet $U_j$=velocity of liquid in jet for two similar impinging jets.

The volumetric flow rate for two jets can be expressed as:

$$Q_j = \frac{\pi d^2}{2} U_j C_c \quad \text{(V)}$$

Since according to the theory of conservation of mass, $Q_s = Q_j$. Substituting in equation (III) we get $$h = \frac{d^2 U_j C_c}{4r U_s} \quad \text{(VI)}$$

Again, assuming viscous forces are not significant, i.e. below $10^4$ cp, $U_j = U_s$ and equation (VI) becomes $$h = \frac{C_c d^2}{4r},$$

the thickness of the axisymmetric sheet at radius r.

Thus, it can be seen that the thickness of the liquid sheet is inversely proportional to the radius, r.

The coefficient of contraction for a sharp edged orifice ranges from about 0.65 to 0.67. Taking an average value of about 0.66, we can calculate sheet thicknesses for a given pair of orifices with diameter, d. Table I shows the results of these calculations.

TABLE I

| Orifice Diameter | Thickness, h, of Liquid Sheet at Radius r | | | |
|---|---|---|---|---|
| d | r = 12.7 cm | r = 15.2 | r = 17.8 | r = 20.3 |
| 2.38 mm | 7.4 microns | 6.1 microns | 5.3 microns | 4.6 microns |
| 3.18 mm | 13.1 microns | 10.9 microns | 9.4 microns | 8.2 microns |
| 3.97 mm | 20.4 microns | 17.0 microns | 14.6 microns | 12.8 microns |
| 4.76 mm | 29.5 microns | 24.5 microns | 21.1 microns | 18.4 microns |
| 6.35 mm | 52.3 microns | 43.6 microns | 37.3 microns | 32.8 microns |

Figure 3:
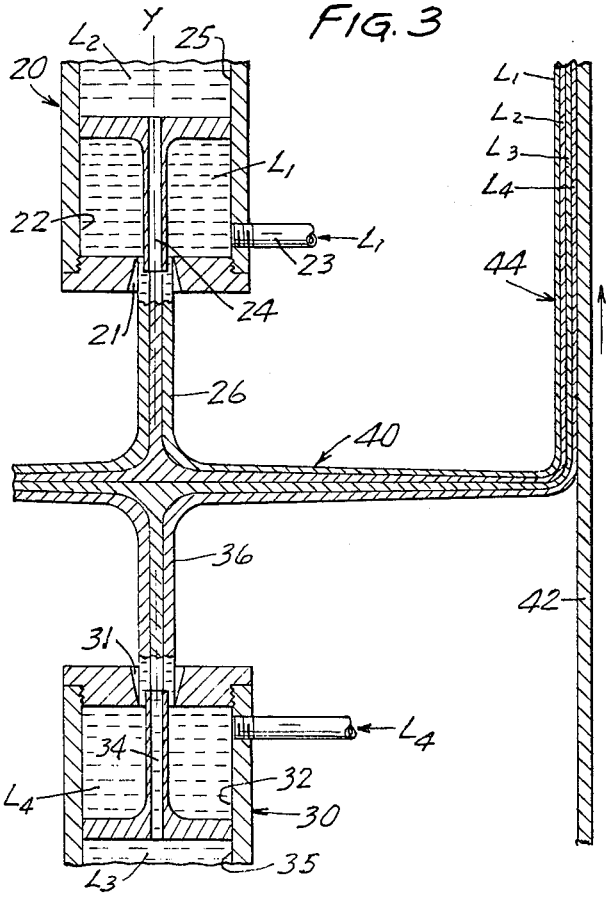
FIG. 3 is a cross section of a jet impingement coating system adapted to simultaneously apply up to four discrete coating layers on a moving substrate.

FIG. 3 shows a cross section of a coating system for producing a multi-layered coating by means of composite jets. Composite orifice tube 20 contains concentric orifices 21 and 24 wherein annular orifice 21 opens to chamber 22 containing liquid $L_1$ fed under pressure through supply line 23. Central orifice 24 opens to chamber 25 containing liquid $L_2$ under pressure. Liquids $L_1$ and $L_2$ issue simultaneously from orifices 21 and 24 as composite jet 26. Similarly, orifice tube 30 contains concentric orifices 31 and 34, wherein annular orifice 31 communicates with chamber 32 containing liquid $L_4$ fed under pressure through supply line 33. Central orifice 34 opens to chamber 35 containing liquid $L_3$ under pressure. Liquids $L_2$ and $L_4$ issue simultaneously from orifices 31 and 34 as composite jet 36.

Composite jets 26 and 36 have equal momentums and impinge to form liquid sheet 40 disposed in a horizontal plane. Liquid sheet 40 propagates radially and symmetrically outward from the point of impingement of jets 26 and 36 in a laminar flow mode and layers comprising liquids $L_1$, $L_2$, $L_3$, and $L_4$ remain distinct.

When composite jets are employed the orifices are preferably arranged so that the core of the composite jet is formed before the outer portion of the jet is formed as this aids in the formation of a stable jet. Preferably the core stream should have an equal or slightly greater initial velocity compared to the outer jet although the velocity of the two portions of the jet quickly equalize due to momentum exchange. If the outer portions of the composite jet have a greater initial, the jet may tend to collapse.

Thus, to facilitate the formation of stable jets, the discharge surface of the concentric orifices 21, 24, 31, and 34 may be coplanar or they may be staggered as shown in FIG. 3, i.e. one or more surfaces being in different planes. It is preferred that the discharge surface of the outer orifice (e.g. orifices 21 and 31 in FIG. 3) extend beyond the discharge surface of the innermost orifice (e.g. orifices 24 and 34 in FIG. 3). In the case of biliquid composite jets, the discharge surface of the inner orifice should be further back along the axis of the produced jet than the discharge surface of the outer orifice (as shown in FIG. 3). When multi-liquid jets having three or more concentric streams are employed, it is preferred, but not essential, that the discharge surface of each outer orifice extend beyond the discharge surface of any orifice nearer to the central axis of the composite jet.

Substrate 42 intercepts sheet 40 in a plane perpendicular to the plane of liquid sheet 40. Substrate 42 travels at a velocity substantially equal to the velocity of the liquid in sheet 40. Liquid sheet 40 impinges on the surface of substrate 42 and forms multi-layered coating 44 containing distinct layers, $L_1$, $L_2$, $L_3$ and $L_4$. As with the system shown in FIG. 2, the thickness of coating 44 can be varied by causing the substrate 42 to intercept sheet 40 at varying distances from the point of impingement of composite jets 26 and 36 within the breakup radius of sheet 40. It is also possible to vary the coating thickness by increasing the velocity of the substrate relative to the velocity of the liquid in sheet 40.

As noted previously, the liquid sheets of the present invention can be formed so as to be symetric about the point of impingement of the liquid jets or can be formed to be asymmetric about the point of impingement. The shape of the liquid sheet is determined by the angle of impingement of the liquid jets which form the liquid sheet. Opposing jets which are uniaxial, i.e. impinge at an angle of 180°, form a symetric, circular sheet, whereas jets which impinge at angles other than 180° will form asymmetric sheets. For some applications the symmetric sheets are preferred due to the uniform thickness and velocity of the sheet at any given distance from the point of impingement of the liquid jets. Asymmetric sheets can be useful in certain applications to provide a coat ing which varies in thickness across the substrate on which the liquid impinges or to reduce waste of liquid where a narrow or non encircling substrate is to be used.

Figure 4:
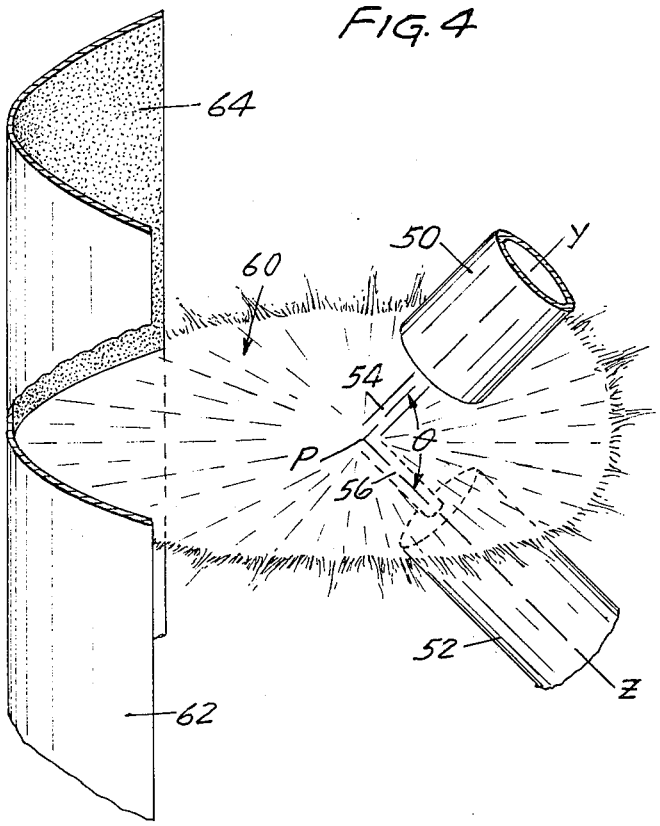
FIG. 4 is a perspective view of an alternate embodiment of a jet impingement coating system wherein the jets impinge at an angle other than 180° to form an asymmetric liquid sheet which is used to coat a moving substrate.

FIG. 4 is a perspective view of an embodiment of a jet impingement coating system wherein the liquid sheet formed by impingement of a pair of liquid jets is not symmetric about the point of impingement. In this embodiment, orifice tubes 50 and 52 are disposed in a vertical plane and aligned so that their axes intersect at an angle other than 180°. Jets 54 and 56 are shown discharging from orifice tubes 50 and 52, respectively, and preferably have equal momentums. Asymmetric liquid sheet 60 is formed at the point of impingement.

Liquid sheet 60 propagates radially outward from the point of impingement in a substantially horizontal plane, but because of the angled impingement of jets 54 and 56, sheet 60 is not symmetric about the point of impingement. Sheet 60 is formed having a breakup radius which is not equal in all directions about the point of impingement of liquid jets 54 and 56 as shown in FIG. 4. Substrate 62 intercepts sheet 60 at a variable radius within the sheet such that the liquid sheet 60 is of equal thickness at each point of interception. Accordingly, substrate 62 is deformed into a parabolic arc to satisfy the above requirement that the thickness of sheet 60 is the same at each point of impingement of substrate 62.

As with the system shown in FIG. 1, substrate 62 moves vertically with respect to horizontal sheet 60 at a velocity substantially the same as the velocity of the liquid in sheet 60 so that a continuous coating 64 is applied to a surface of substrate 62.

The angle of impingement of jets 54 and 56 can be varied considerably from nearly 180°, wherein the liquid sheet which is formed is nearly symmetric, to angles which are considerably less than 180°, but which still allow formation of a liquid sheet in a laminar flow mode. Impingement of the liquid jets at angles other than 180° may have certain advantages in that the asymmetric shape of the liquid sheet can be utilized to provide a non-uniform coating or to direct the sheet toward a specific area and thereby reduce waste of liquid.

Figure 5:
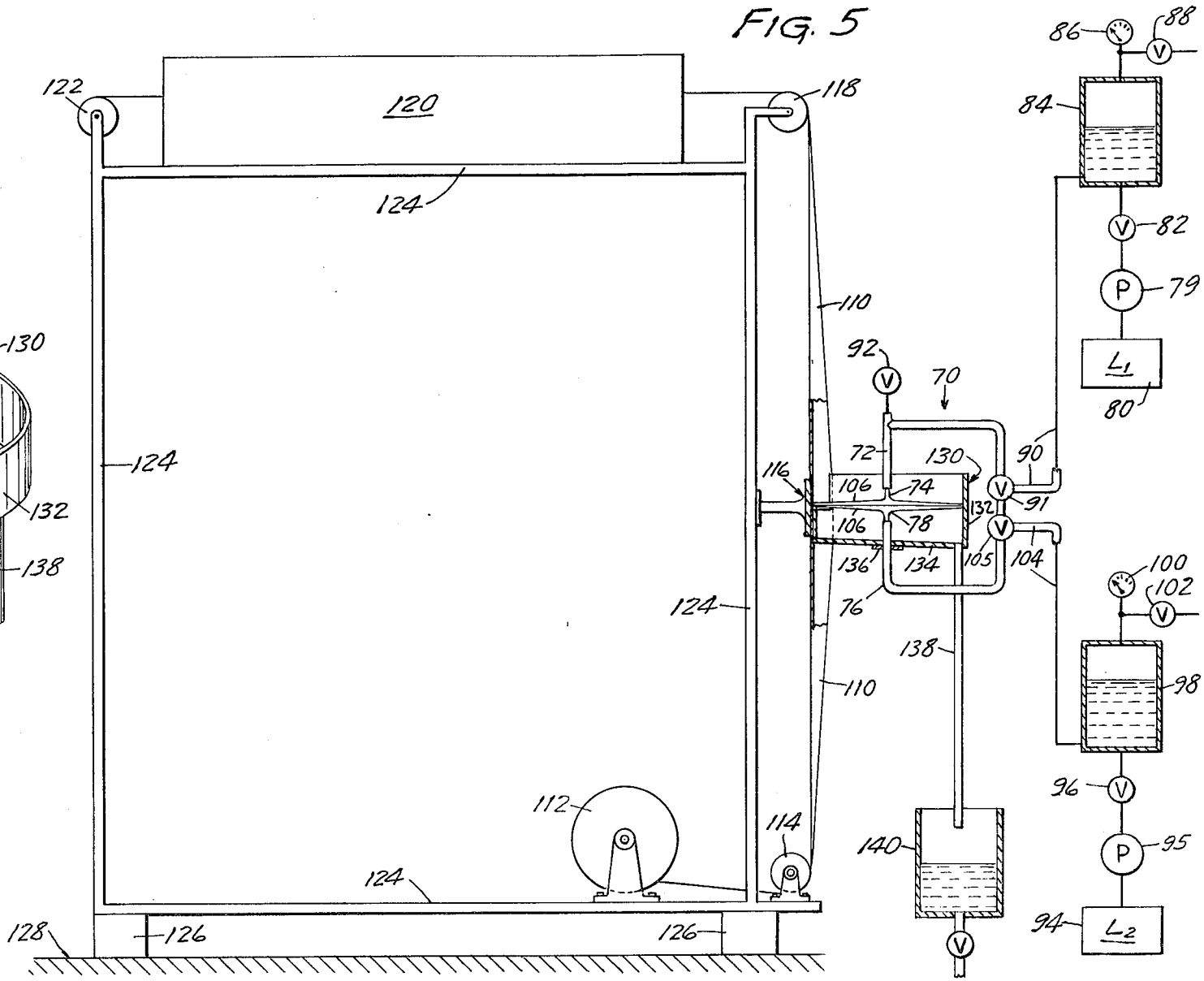
FIG. 5 is a schematic view of an apparatus adapted for coating a moving substrate with a jet impingement coating system.

FIG. 5 is a schematic view of a coating apparatus employing a jet impingement coating system similar to that shown in FIG. 1 wherein a coating station for coating a moving web, shown generally at 70, is shown. The coating station comprises upper orifice tubes 72 discharging liquid jet 74 and lower orifice tube 76 discharging liquid jet 78. Liquid $L_1$ is fed under pressure provided by pump 79 from liquid reservoir 80 through pressure-adjusting valve 82 to a pressure damping chamber 84 equipped with pressure gauge 86 and relief valve 88. The pressure damping chamber 84 is used to minimize the effects of sudden changes in pressure which may occur in reservoir 80. Liquid $L_1$ then flows through supply line 90, valve 91 and into orifice tube 72. Air relief valve 92 is used to bleed air from the orifice tube when the tube is initially filled with liquid on startup or when draining the system to change liquids.

Similarly $L_2$ is fed under pressure provided by pump 95 from reservoir 94 through pressure adjusting valve 96 to a pressure damping chamber 98 equipped with pressure gauge 100 and relief valve 102. Liquid $L_2$ then flows through supply line 104, valve 105 and into orifice tube 76.

Jets 74 and 78 are discharged from orifice tubes 72 and 76, respectively, to form free, symmetric liquid sheet 106 which propagates radially outward from the point of impingement of jets 74 and 78.

Substrate 110 is shown feeding from substrate supply roll 112 over lower idler roll 114 and traveling vertically upward through substrate-forming guide 116 over upper idler roll 118, through conditioner 120 onto takeup roll 122, the rolls and conditioner being supported by frame members 124, support box 126, and floor 128.

As substrate 110 passes through guide 116 the substrte is temporarily formed to have a curved surface, e.g. a constant radius arc, so that the substrate 110 intercepts liquid sheet 106 within the breakup radius of sheet 106.

Collecting pan 130 is employed at coating station 70 to catch the liquid not intercepted by substrate 110. Collecting pan 130 comprises an upright semicircular wall portion 132 and a base 134 supported by base support 136. Pan 130 is slanted downwardly away from substrate 110. A drain pipe 138 is provided at the low point in the bottom of pan 130 to draw the collected liquid from pan 130 to collecting chamber 140. The liquid in collecting chamber 140 can be recirculated, separated and/or otherwise reprocessed or disposed of. If the liquid in chamber 140 comprises a mixture of liquids, separating techniques may be employed to obtain the individual liquids for recirculation to reduce waste.

As substrate 110 passes coating station 70 and intercepts liquid sheet 106, a continuous coating layer is applied to the inwardly curved surface of substrate 110. The coating adheres to the substrate and is pulled along with the substrate through conditioner 120, which may be a heating, cooling, drying, irradiating, or other conditioning means. If necessary, conditioning means may be arranged to condition the coating closer to the application of the coating to the substrate to quickly congeal the coating after application. In some cases, the liquid coating applied to substrate 110 may be of such character, e.g., low viscosity, so as to tend to diffuse or mix on impact with the moving substrate. Accordingly, certain liquid materials useful in the practice of the present invention must be treated so as to resist diffusion after impact, such as by adding curatives or flow control agents, by drying, cooling (e.g., chilling) or by otherwise treating with external solvent removal or viscosity building means immediately on application of the liquid to the substrate.

The substrate to be coated should preferably move in a direction approximately perpendicular to the plane of the liquid sheet, although other impingement angles can be used to advantage. While FIG. 5 shows a substrate 110 intercepting only a portion of the liquid sheet 106, it is most advantageous to have a substrate material concentrically surrounding a substantial portion of the liquid sheet so as to have a major portion of the circumference of the liquid sheet impinge upon the inner surface of the surrounding substrate. The substrate sheet may then be opened up to yield a flat coated sheet. Alternatively, individual substrate sheets may be passed in a direction perpendicular to the plane of the liquid sheet collectively surrounding the liquid sheet so as to have the liquid sheet impinge upon the surfaces of the several substrates simultaneously. The use of surrounding substrates may be particularly important where composite liquid sheets are used and the waste liquid cannot be conveniently separated and recirculated.

Figure 6:
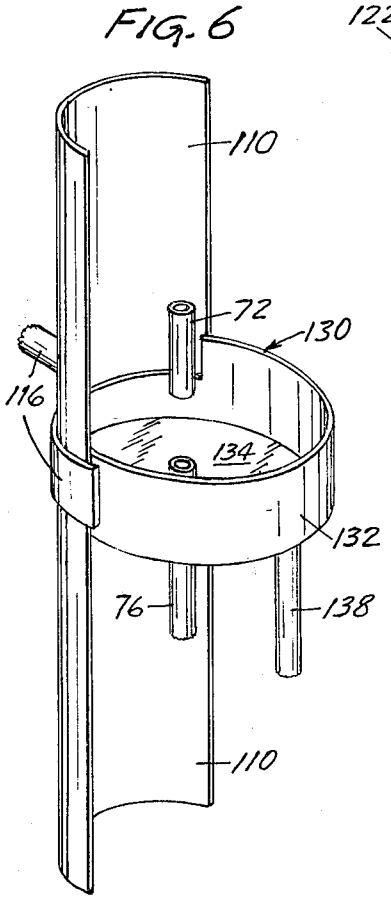
FIG. 6 is a perspective view of the coating station portion of the apparatus shown in FIG. 5.

FIG. 6 is a perspective view of a portion of the coating station 70 shown in FIG. 5 wherein orifice tubes 72 and 76 are shown uniaxially opposed such that jets which are discharged from the tubes will impinge at an angle of 180° to form a symmetric liquid sheet. Substrate 110 is shown disposed parallel to the common discharge axis of orifice tubes 72 and 76, and is formed and maintained in a constant radius arc by substrate guide 116.

Collecting pan 130 comprises an upright sidewall 132 semiencircling the common axis of orifice tubes 72 and 76 and disposed so as to intercept a liquid sheet formed in a horizontal plane approximately midway between the opposed ends of orifice tubes 72 and 76. Base 134 of collecting pan 130 is connected to the bottom edge of wall 132 with a lip portion extending toward the center of substrate 110 and extending slightly beyond the inwardly curved edges of substrate 110. Base 134 is angled downwardly from the horizontal away from substrate 110 so that the collected waste liquid will run toward drain 138 located in and extending from the bottom 134 of pan 130.

EXAMPLE 1

An apparatus as shown in FIG. 5, wherein the liquid sheet forming means comprises a pair of uniaxially opposed jets, was used to coat a polyester sheet. The jets each had an orifice diameter of 5/32 inch (0.397 cm). A solution having the following formulation was prepared:

| | |
|---|---|
| Polyethylene oxide | 0.31% |
| Saponin | 0.012% |
| Water | 99.678% |

This solution was determined to have a surface tension of 35.5 dynes/cm and a viscosity of 200 centipoise. The liquid velocity in the free, liquid sheet was determined to be about 600 ft/min (3 meters/sec). A 10 inch (25.4 cm) wide polyester substrate was passed through a radius guide curved to a radius of 6 inches (15.2 cm) and the polyester substrate located to intercept the liquid sheet at a constant radius of about 6 inches (15.2 cm) from the point of impingement of the liquid jets which form the liquid sheet.

A uniform coating of 0.67 mils (17 microns) wet thickness was obtained on the substrate. The coating was allowed to dry in a horizontal position for about 10 to 15 minutes at room temperature to provide a uniform continuous coating on the polyester substrate.

EXAMPLE 2

Apparatus and coating procedures described generally in Example 1 were used to coat a polyester substrate. The liquid velocity (pressure) was controlled to form a stable liquid sheet and the substrate velocity was matched to the velocity of the liquid in the liquid sheet.

| Sample No. | Ingredient | % by Weight | Viscosity, cps | Surface Tension dynes/cm | Coating Speed m/sec. | Coating Thickness wet, microns |
|---|---|---|---|---|---|---|
| 1 | Polyethylene Oxide | 4.2% | | | | |
| | Surfactant** | 0.1 | 300 | 36 | 2.5 | 50.8 |
| | Water | 95.7 | | | | |
| 2 | Polyethylene Oxide | 3.7% | | | | |
| | Surfactant* | 0.15 | 180 | 33 | 2.2 | 38 |
| | Water | 96.15 | | | | |
| 3 | Polyethylene Oxide | 3.7% | | | | |
| | Surfactant* | 0.15 | 180 | 33 | 2.8 | 29.2 |
| | Water | 96.15 | | | | |
| 4. | Polyethylene Oxide | 1.7% | | | | |
| | Surfactant* | 0.3 | 38 | 32.8 | 3.0 | 27.4 |
| | Water | 98.0 | | | | |
| 5. | Gelatin | 10% | | | | |
| | Surfactant* | 0.5 | 30 | 31.7 | 2.8 | 22.9 |
| | Water | 89.5 | | | | |
| 6. | Gelatin | 5% | | | | |
| | Surfactant* | 0.5 | 20 | 31.7 | 2.3 | 27.9 |
| | Water | 94.5 | | | | |

*Surfactant is Triton X-20 available commercially from Rohm & Haas Company

A uniform liquid coating was applied to the substrate and the coated substrate was dried in a horizontal position at room temperature to provide a substrate with distinct layers coated thereon.

EXAMPLE 3

Polyester subtrates were coated as in Example 1 using various organic solvents in the coating solutions. The results are summarized in Table III below.

TABLE III

| Major Solid Content | Major Solvent | Coating Speed m/sec | Viscosity, cps | Surface Tension, dynes/cm | Coating Thickness Wet, microns at Web Speed of 1.5 m/sec | 3.0 m/sec |
|---|---|---|---|---|---|---|
| Iron Oxide (~40% solid in solvent) | MEK Toluene | 1.5 to 3.0 | 25–500 Non-Newtonian | 34 | 50 | 25 |
| Silicone (5% solid, in solvent) | Heptane MEK | 2.5 | 9 | 25 | | 25 |
| Zinc Oxide (46% solid in solvent) | Toluene | 2.5 to 4 | 100–200 | 30–40 | 37 | 20 |

The coated substrates were dried in a horizontal position at room temperature to provide a uniformly covered substrate with various coating thickness thereon.

EXAMPLE 4

Substrates were coated as in Example 1, except that each of the liquid jets comprised a different liquid composition. The results are summarized in Table IV below. The substrate velocity was matched to the velocity of liquid in the sheet.

TABLE IV

| Coating | Solvent | Coating Speed, m/sec | Viscosity, cps | Surface Tension, dynes/cm | Coating Thickness Wet, microns |
|---|---|---|---|---|---|
| Top Coat: | | | | | |
| Silver Emulsion* | Water | | 16 | 34 | 19 |
| Bottom Coat: | | | | | |
| Clear Gelatine** | Water | 3.5 | 20 at 40° C. | 34 | 19 |
| Top Coat: | | | | | |
| Clear Gelatine** | Water | | 20 | 34 | 19 |
| Bottom Coat: | | | | | |
| Silver Emulsion* | Water | 3.5 | 16 at 40° C. | 34 | 19 |

*7.5% Silver, 3.3% Gelatine + 89.2% water
**10.0% Gelatine + 90% $H_2O$

The sheets were dried in a horizontal position at room temperature to obtain uniformly coated sheets having distinct coating layers thereon.

EXAMPLE 5

Three and four layer coatings on a polyester substrate using apparatus like that shown in FIG. 5 were prepared. A pair of concentric jets like those shown in FIG. 3 were employed. Silver emulsion and gelatine were used as the two different coating liquids. The gelatine coating liquid comprised by weight, 10% gelatine, 89.55% deionized water and 0.45% saponin and had a viscosity of 10 centipoises and a surface tension of 30 dynes/cm. The silver emulsion comprises, by weight, 7.5% silver bromide, 3.3% gelatine, 88.5% deionized water and 0.7% glycerine, and had a viscosity of 10 centipoises and a surface tension of 38.5 dynes/cm.

The composite nozzle for forming each of the concentric jets had an outer nozzle having an inside diameter of 0.188 inches (0.5 cm) and an inner concentric nozzle having an inside diameter of 0.12 inches (0.3 cm) and an annular thickness of 0.01 inches (0.25 mm).

The three layer coating was formed by the impingement of two concentric jets with the internal liquid jets comprising identical liquid material. The velocity of the liquid and the polyester substrate were substantially matched at about 700 ft/min (3.5 m/sec) for the three-layer coating and 600 ft/min (3.0 m/sec) for the four-layer coating.

Under these conditions layered coatings having the following compositions and wet film thicknesses were obtained (the layer designated "1st" being adjacent the polyester substrate).

| | Three layer (wet thickness in microns) | | | Four layer (wet thickness in microns) | | | |
|---|---|---|---|---|---|---|---|
| Coating Liquid | 1st | 2nd | 3rd | 1st | 2nd | 3rd | 4th |
| Gelatine | 2.5 | | | 4 | | | |
| Silver | | 20 | | | 15 | | |
| Gelatine | | | 4 | | | 15 | |
| Silver | | | | | | | 4 |

The coated substrates were chilled to solidify the coating and dried in a horizontal position at room temperature. Uniform coatings having distinct layers were obtained.

EXAMPLE 6

Three and four layered coatings were prepared as in Example 5 except that the configuration of the nozzles was altered so that layers having nearly equal thicknesses could be obtained.

The gelatine coating liquid comprised, by weight, 10% gelatine, 89.05% deionized water, 0.45% saponin and 0.5% of a potassium salt of a fluorinated carboxylic acid ($C_8F_{17}SO_2N(C_2H_5)CH_2CO_2K$) and had a viscosity of 10 centipoises and a surface tension of 21 dynes/cm. The silver emulsion comprised, by weight, 7.5% silver bromide, 3.3% gelatine, 88% deionized water, 0.7% glycerine and 0.5% of the aforementioned fluorinated carboxylic acid potassium salt, and had a viscosity of 10 centipoises and a surface tension of 22 dynes/cm.

The composite nozzle had an outer nozzle having an inside diameter of 0.25 inches (0.64 cm) and an inner concentric nozzle having an inside diameter of 0.12 inches (0.03 cm) and an annular thickness of 0.01 inches (0.25 mm).

The three layer coating was formed by the impingement of two concentric jets with the internal liquid jets comprising identical liquid material. The velocity of the liquid and the polyester substrate were substantially matched at about 600 ft/min (3 m/sec) for the three-layer coating, and 500 ft/min (2.5 m/sec) for the four-layer coating.

Under these conditions layered coatings having the following compositions and wet film thicknesses were obtained (the layer designated "1st" being adjacent the polyester substrate).

| | Three Layer | | | Four Layer | | | |
|---|---|---|---|---|---|---|---|
| | (wet thickness in microns) | | | | | | |
| Coating Liquid | 1st | 2nd | 3rd | 1st | 2nd | 3rd | 4th |
| Gelatine | 20 | | | 17 | | | |
| Silver | | 17 | | | 15 | | |
| Gelatine | | | 20 | | | 15 | |
| Silver | | | | | | | 17 |

The coated substrates were chilled to solidify the coating and dried in a horizontal position at room temperature. Uniform coatings having distinct layers were obtained.

What is claimed is:

1. A method for coating a liquid on a substrate comprising (a) providing at least one liquid jet issuing from a nozzle means in laminar flow, (b) impinging said jet on a deflecting mass to form a continuous, radially-propagating, free, composite liquid sheet comprising a plurality of distinct layers in a laminar flow mode and (c) moving a sheet-like substrate to be coated relative to the plane of said liquid sheet so as to intercept at least a portion of said liquid sheet within the periphery, thereby causing said liquid to impinge on said substrate and to coat one surface of said substrate.

2. A method according to claim 1 wherein there is provided a pair of liquid jets in opposed, uniaxial alignment and said jets impinge on each other to form said liquid sheet and wherein each of said jets comprise distinct liquid species, each jet forming, upon impingement of the jets, a distinct layer of said composite liquid sheet.

3. A method according to claim 1 wherein at least one of said liquid jets is a composite jet which comprises a plurality of streams of differing liquid species in respective annular relationship, the liquid species forming the outermost annular stream of said composite jet becoming, upon impingement of said jets, an outer distinct layer of the resulting composite, free liquid sheet.

4. A method according to claim 2 wherein both of said liquid jets comprise composite jets having a plurality of liquid streams in respective annular relationship, the liquid stream forming the outermost annulus of each of said jets becoming, upon impingement of said jets, an outer distinct layer of the resulting composite free liquid sheet, the innermost annular stream of said liquid jet becoming, upon impingement of said jets, the innermost adjacent distinct layer of said composite liquid sheet, and the remainder of said plurality of liquid streams forming annular portions of said composite jets becoming, upon impingement of said jets, respective distinct layers of said composite, free, liquid sheet.

* * * * *